US012091878B1

(12) United States Patent
Cummings, Sr.

(10) Patent No.: US 12,091,878 B1
(45) Date of Patent: Sep. 17, 2024

(54) POOL SKIMMER SAFETY TOOL

(71) Applicant: Ronald Lynn Cummings, Sr., Magnolia, TX (US)

(72) Inventor: Ronald Lynn Cummings, Sr., Magnolia, TX (US)

( * ) Notice: Subject to any disclaimer, the term of this patent is extended or adjusted under 35 U.S.C. 154(b) by 0 days.

(21) Appl. No.: 18/516,554

(22) Filed: Nov. 21, 2023

(51) Int. Cl.
*E04H 4/16* (2006.01)
*E04H 4/06* (2006.01)

(52) U.S. Cl.
CPC ..... *E04H 4/16* (2013.01); *E04H 4/06* (2013.01); *E04H 4/1636* (2013.01)

(58) Field of Classification Search
CPC .... E04H 4/16; E04H 4/06; B25G 1/02; B25G 3/12
See application file for complete search history.

(56) References Cited

U.S. PATENT DOCUMENTS

| | | | | |
|---|---|---|---|---|
| 5,342,513 | A | 8/1994 | Wall et al. | |
| 5,456,684 | A * | 10/1995 | Schmidt | A61M 1/772 606/174 |
| 7,854,455 | B2 | 12/2010 | Ruscil et al. | |
| 8,939,481 | B1 * | 1/2015 | Qi | E01H 1/1206 294/1.4 |
| 9,469,951 | B1 * | 10/2016 | Qi | E01H 1/1206 |
| 9,578,850 | B2 * | 2/2017 | Taylor | A01K 1/01 |
| 2012/0118594 | A1 * | 5/2012 | Troudt | B25G 1/04 173/18 |
| 2017/0027154 | A1 * | 2/2017 | Waller | B25G 1/102 |
| 2019/0275659 | A1 | 9/2019 | Conrad | |
| 2022/0039308 | A1 * | 2/2022 | Menbere | B25G 1/04 |

* cited by examiner

*Primary Examiner* — Michael D Jennings

(57) ABSTRACT

A pool skimmer safety tool for grabbing items from a distance, the safety tool having a pincer mechanism attached to an elongated member and a grip. The pincer mechanism is actuated with a trigger located on the grip to transition between an open and closed position. The trigger may transfer force to an actuation mechanism such as a gear, the gear actuating the pincer mechanism to allow the pincer mechanism to open and close when the trigger is pulled. The safety tool may have a hook on the rear end to allow a user to hook items, such as skimmer lids, from a safe distance.

17 Claims, 8 Drawing Sheets

POOL SKIMMER SAFETY TOOL

FIELD OF THE INVENTION

The present invention relates generally to pool work tools and accessories. Specifically, the present invention is a pool skimmer safety tool having a pincer style gripping mechanism.

BACKGROUND OF THE INVENTION

Pools are often receptacles for large amounts of debris, trash, insects, and other detritus from the environment. Such detritus may fall into the pool and sink to the bottom. Many pools have skimmers or other tools that collect and deposit this matter into a collection bin. However, a user or cleaning person must still periodically clean the collection bin. This task can be unpleasant due to the high degree of detritus that collects within the collection bin, and in some regions, this can be downright dangerous due to the propensity of dangerous animals such as snakes that may be residing within the collection bin. There thus exists in a need for a safe way to manipulation pool skimmer bins and to collect pool trash from an appropriate distance.

The present invention aims to solve this problem by providing an improved design for a pool skimmer safety tool. The pool skimmer safety tool may comprise a pistol-style grip, a pincer mechanism, an elongated body, and a hook. The pistol style grip may further comprise a trigger that serves to actuate the pincer mechanism. The trigger and pistol style grip may be positioned on the opposite end of the elongated body from the pincer mechanism. When the trigger is actuated, the pincer mechanism may transition between an opened and closed position, allowing a user to safely grab and manipulate objects from a distance without needing to bend over. The hook may be positioned on the back side of the pistol style grip, and may be adapted to allow the user to hook into a skimmer collection basket or similar object to remove the object from the object's housing, and move the object into a better location to remove any detritus.

DETAIL DESCRIPTIONS OF THE INVENTION

Figure 1:
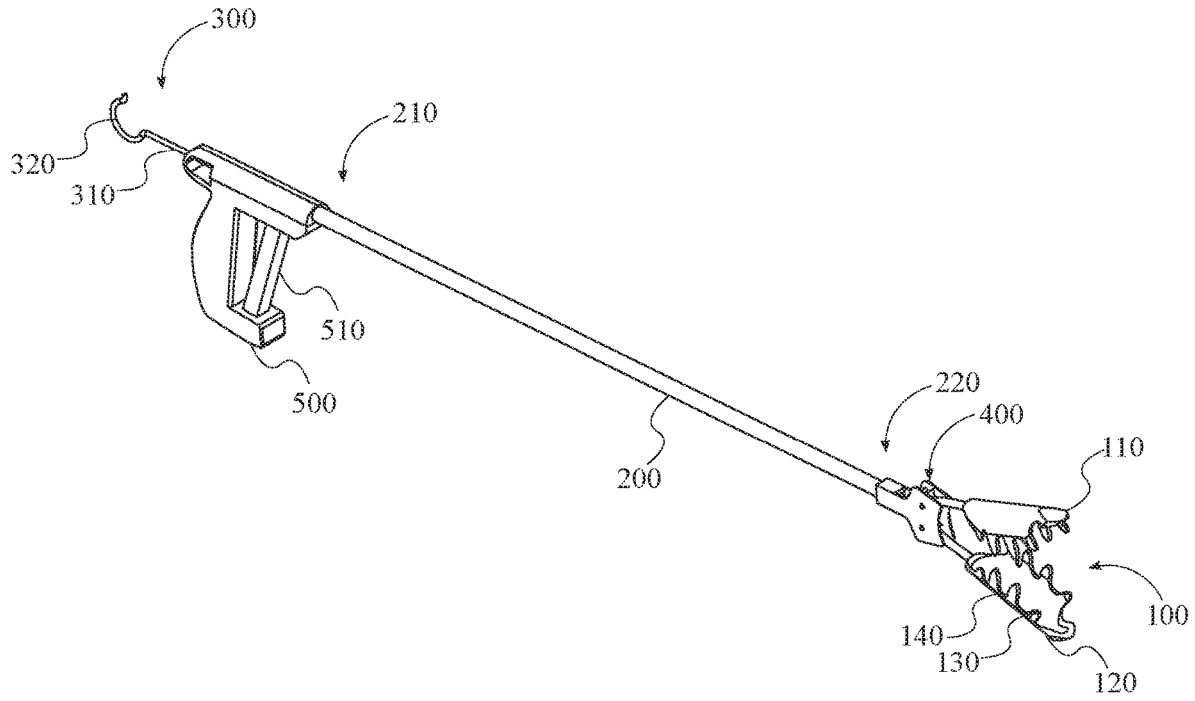
FIG. 1 is a front perspective view of the present invention.
Figure 2:
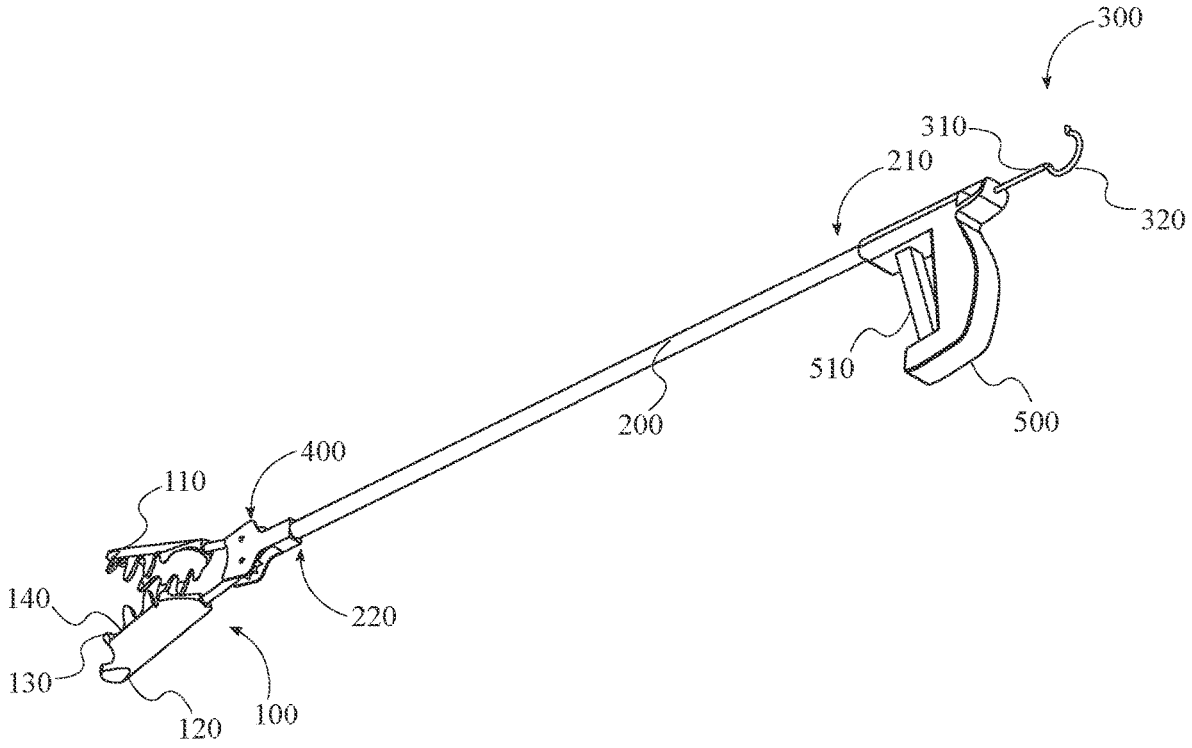
FIG. 2 is a back perspective view of the present invention.
Figure 3:
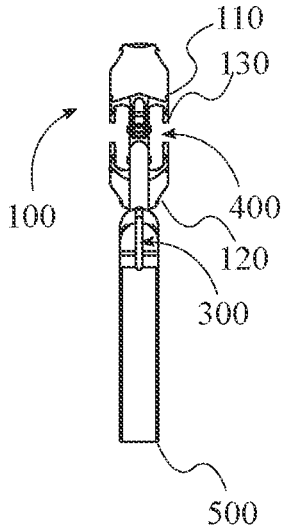
FIG. 3 is a rear view of the present invention.
Figure 4:
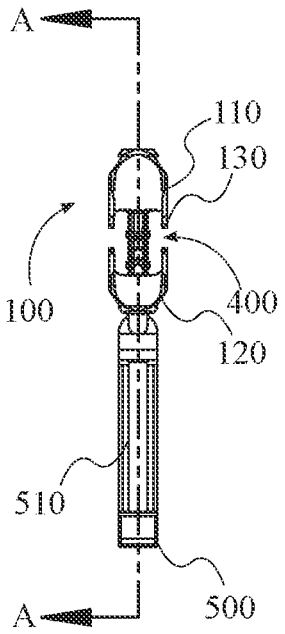
FIG. 4 is a front view of the present invention.

All illustrations of the drawings are for the purpose of describing selected versions of the present invention and are not intended to limit the scope of the present invention.

It should be understood that reference to the singular of a component ("a", "an" and "the") should include reference to the plural of the component ("one or more", "at least one", "a plurality of") unless otherwise explicitly stated herein.

The present invention is a pool skimmer safety tool. The pool skimmer safety tool may comprise a pincer mechanism

100, an elongated member 200, a hook 300, a grip 500, a trigger 510, and at least one actuation mechanism 400.

Referring now to FIGS. 1-2 and FIGS. 5-8, in the ideal embodiment, the elongated member 200 may comprise a first end 210 and a second end 220. At the first end 210 of the elongated member 200, the grip 500 is attached, affixed, or otherwise fastened to the first end 210 of the elongated member 200. In the ideal embodiment, the grip 500 is a pistol-style grip. At the second end 220 of the elongated member 200, the pincer mechanism 100 is affixed, attached, or otherwise fastened to the elongated member 200. The elongated member 200 is ideally a rod, tube, or similar member that provides length between the pistol grip 500 and the pincer mechanism 100, allowing the user to keep distance from the pincer mechanism 100 while the pool skimmer safety tool is in use.

Figure 5:
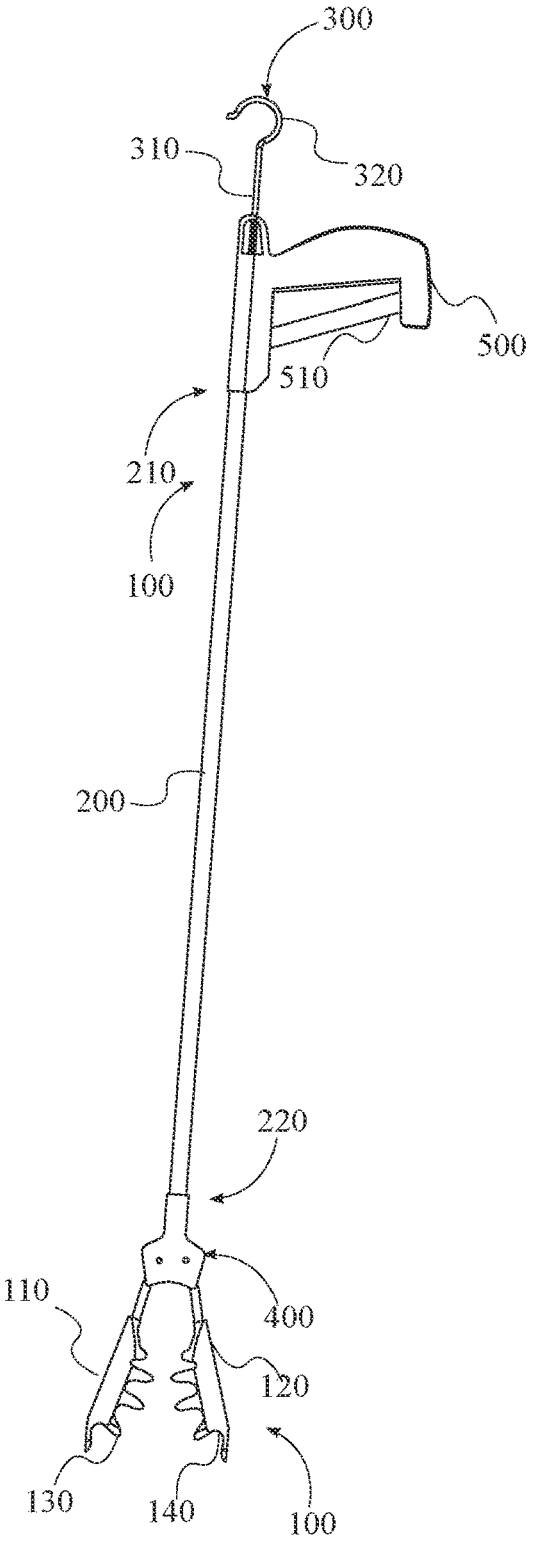
FIG. 5 is a left side view of the present invention, the right side view is a mirror image thereof.
Figure 6:
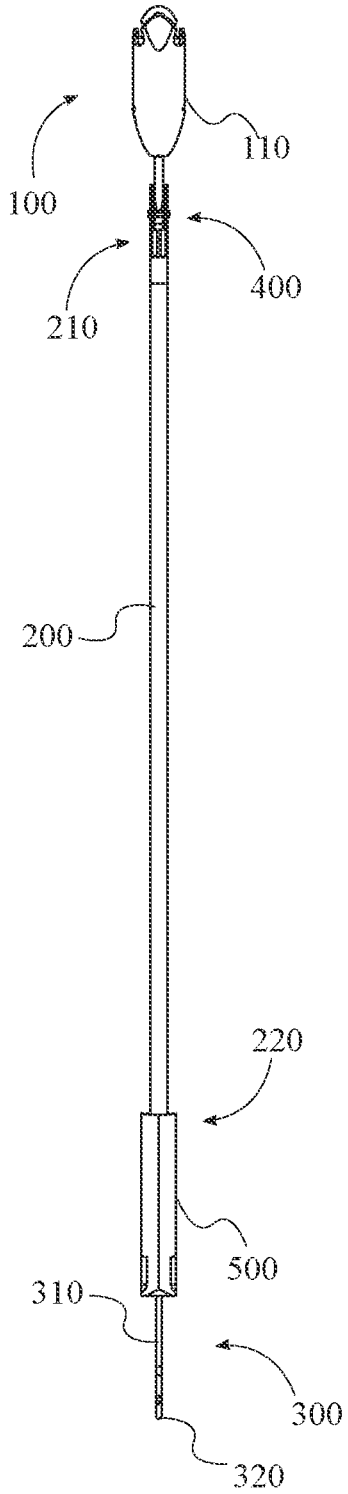
FIG. 6 is a top view of the present invention.
Figure 7:
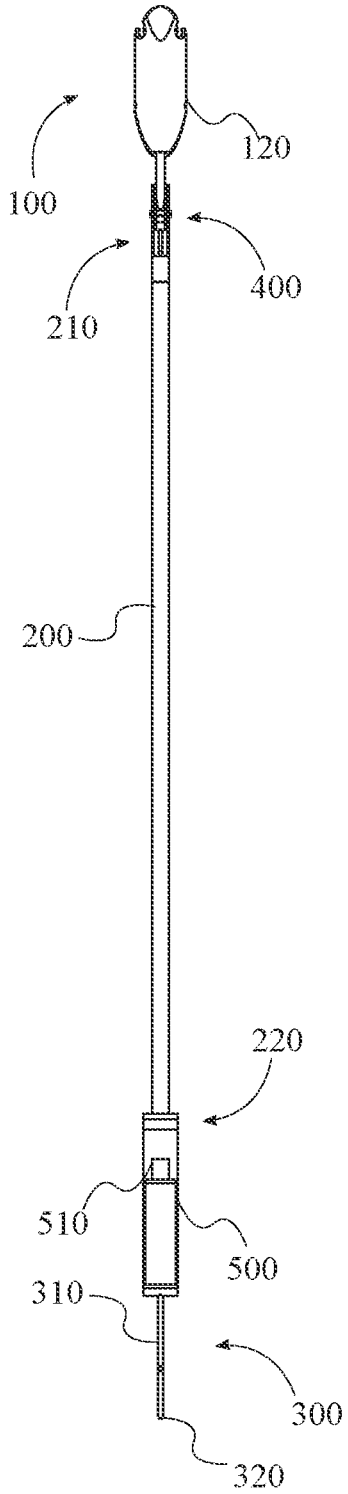
FIG. 7 is a bottom view of the present invention.
Figure 8:
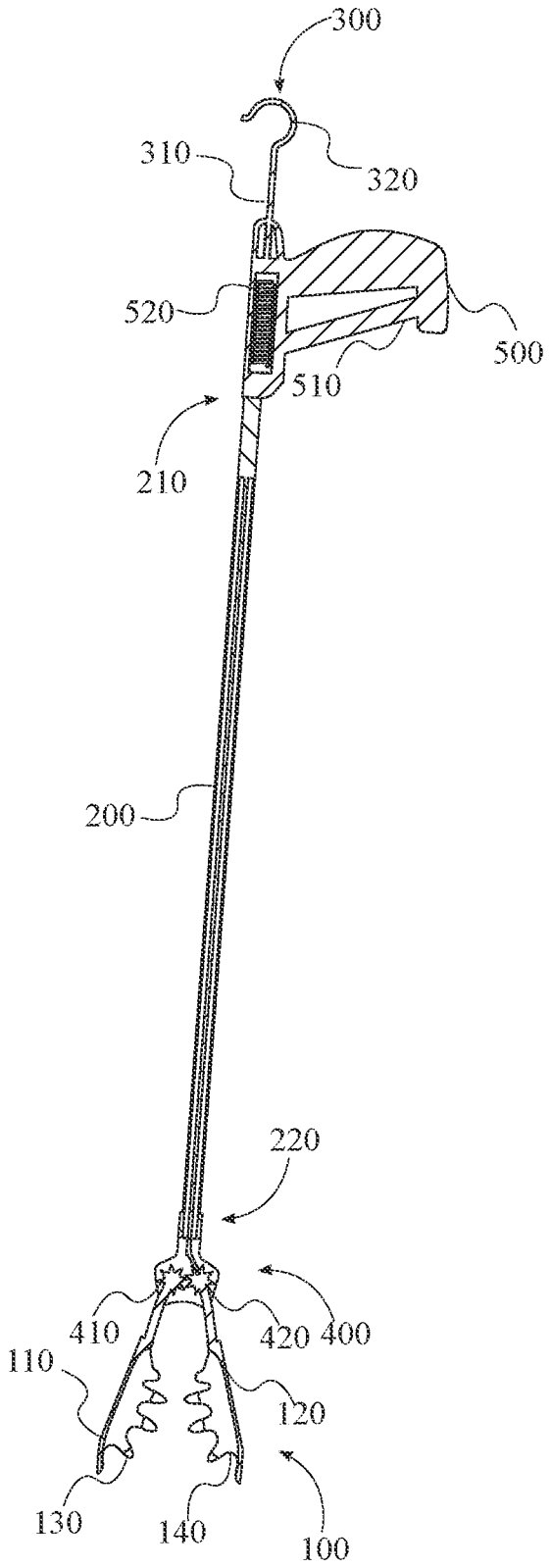
FIG. 8 is a cross-sectional view of the present invention taken along line A-A of FIG. 4.

The hook 300 may be affixed, attached, screwed into, or otherwise fastened to the rear of the pistol grip, as seen in FIG. 5 and FIG. 8. The hook 300 may be either permanently affixed or detachably attached to the rear of the pistol grip 500. The hook 300 may be adapted to comprise at least a first straight portion 310 and a hooked portion 320. The straight portion 310 may provide additional length to the hook 300, and the hooked portion 320 may comprise an arc at the end of the straight portion 310, creating a hooked shape that may allow the user to hook 300 into the lid or side of a skimmer collection box or similar object to lift, move, or otherwise manipulate the object.

As seen in FIG. 1-2 and FIGS. 5-8, the pistol grip 500 may further comprise a trigger 510. The trigger 510 may be pivotably attached to the pistol grip 500 and operatively connected to the elongated member 200. In the ideal arrangement, when the trigger 510 is squeezed by the user, it creates a tension or force on the elongated member 200, either pulling or pushing the elongated member 200. This force or tension will serve to actuate the pincer mechanism 100, closing the pincers, as described in more detail below. In this way, the trigger 510 is further operatively connected to the actuation mechanism 400. Though the ideal embodiment of the pistol grip 500 may comprise a trigger 510, other triggering mechanisms with similar configurations and functions are considered within the spirit and scope of the invention.

As seen in FIGS. 1-5 and FIG. 8, the pincer mechanism 100 may be positioned at the second end 220 of the elongated member 200. In the ideal embodiment, the pincer mechanism 100 may comprise a first gripper 110, a second gripper 120, and at least one actuation mechanism 400. The at least one actuation mechanism 400 may further comprise at least one first gear 410 and at least one second gear 420. The first gripper 110 and second gripper 120 may be affixed on lateral opposite sides of the second end 220 of the elongated member 200. The at least one actuation mechanism 400 may be operatively connected to the first gripper 110 and the second gripper 120, such that when the actuation mechanism 400 is actuated, the first gripper 110 and second gripper 120 and moved from an open position with the grippers spaced apart, to a closed position with the grippers forced together to hold an object between the first gripper 110 and the second gripper 120. The actuation mechanism 400 may be actuated when the user squeezes the trigger 510 on the pistol grip, applying a force by pulling on the elongated member 200, and that force being transferred to actuate the actuation mechanism 400. In some embodiments, the pincer mechanism 100 may be biased into an open position using a spring 520. The spring 520 keeps the pincer mechanism 100 open until the trigger 510 is actuated. When the trigger 510 is actuated, the spring 520 tension is removed, and the pincer mechanism 100 transitions to a closed position. The spring is ideally positioned at the first end 210 of the elongated member, between the first end 210 of the elongated member and the grip 500.

In the ideal embodiment, the first gripper 110 and second gripper 120 may further comprise a plurality of interlocking teeth 130, as seen in FIGS. 1-2 and FIG. 5-8. The plurality of interlocking teeth 130 on the first gripper 110 may be adapted to slot into a plurality of slots 140 in the second gripper 120, and likewise, the plurality of interlocking teeth 130 on the second gripper 120 may be adapted to slot into a plurality of slots 140 on the first gripper 110. This configuration gives the pincer mechanism 100 the necessary traction to grab the various detritus, debris, or other objects necessary during the cleaning process. Though the ideal embodiment has been described, other configurations for the pincer mechanism 100, first gripper 110, and second gripper 120 that permit gripping of objects between the first gripper 110 and second gripper 120 are within the spirit and scope of the present invention.

In the ideal embodiment, the at least one actuation mechanism 400 may comprise at least one first gear 410 and at least one second gear 420, as seen in FIG. 8. The at least one first gear 410 may be operatively connected to the first gripper 110, and the at least one second gear 420 may be operatively connected to the second gripper 120. In this ideal embodiment, when the trigger 510 is squeezed, the force is transmitted through the elongated member 200 to the at least one first gear 410 and the at least one second gear 420. In some embodiments, the first gear 410 may be operatively connected to the second gear 420, such that the first gear 410 acts to rotate the second gear 420 when the trigger 510 is pulled. The force rotates the at least one first gear 410 and at least one second gear 420. The rotation of the at least one first gear 410 causes the first gripper 110 to move towards the closed position, and the rotation of the at least one second gear 420 simultaneously causes the second gripper 120 to move towards the closed position. Thus, when the trigger 510 is actuated by the user, the pincer mechanism 100 transitions from an open to a closed position. When the trigger 510 is released, the gears counter-rotate to return to the initial position, causing the pincer mechanism 100 to transition from a closed to an open position. Though the ideal embodiment has been described, other actuation mechanisms 400 well-known in the art are contemplated. For example, a plurality gears meshed together may be used to actuate the pincer mechanism 100.

Although the invention has been explained in relation to its preferred embodiment, it is to be understood that many other possible modifications and variations can be made without departing from the spirit and scope of the invention.

I claim:

1. A pool skimmer safety tool comprising:
a pincer mechanism;
an elongated member;
a hook;
an actuation mechanism;
a grip;
a trigger;
the elongated member comprising a first end and a second end;
the grip is positioned at the first end of the elongated member;
the pincer mechanism is positioned at the second end of the elongated member;
the pincer mechanism further comprising a first gripper having a plurality of interlocking teeth and a second gripper having a plurality of interlocking teeth;
the trigger being operatively connected to the actuation mechanism;
the actuation mechanism being operatively connected to the pincer mechanism; and
the actuation mechanism comprising a first gear and a second gear.

2. The pool skimmer safety tool of claim 1, further comprising:
the first gripper and second gripper are positioned laterally on opposite sides of the second end of the elongated member.

3. The pool skimmer safety tool of claim 2, further comprising:
the first gripper further comprising a plurality of slots; and the second gripper further comprising a plurality of slots.

4. The pool skimmer safety tool of claim 3, further comprising:
wherein the plurality of teeth of the first gripper are positioned to slot into the plurality of slots on the second gripper; and
wherein the plurality of teeth on the second gripper are positioned to slot into the plurality of slots on the first gripper.

5. The pool skimmer safety tool of claim 1, further comprising:
the hook further comprising a straight portion and a hooked portion.

6. The pool skimmer safety tool of claim 1, further comprising:
wherein the first gear is operatively connected to the second gear.

7. The pool skimmer safety tool of claim 6, further comprising:
wherein the first gear is further operatively connected to the first gripper and the second gear is operatively connected to the second gripper.

8. The pool skimmer safety tool of claim 1, further comprising:
the trigger is positioned on the grip.

9. The pool skimmer safety tool of claim 1, further comprising:
a spring being positioned between the first end of the elongated member and the grip.

10. The pool skimmer safety tool of claim 1, wherein the hook is detachably attachable to the grip.

11. A pool skimmer safety tool comprising:
a pincer mechanism;
an elongated member;
a hook;
an actuation mechanism;
a grip;
a trigger;
the elongated member comprising a first end and a second end;
the grip is positioned at the first end of the elongated member;
the pincer mechanism is positioned at the second end of the elongated member;
the trigger is positioned on the grip;
the trigger being operatively connected to the actuation mechanism;
the actuation mechanism being operatively connected to the pincer mechanism;

the pincer mechanism further comprising a first gripper and a second gripper;

the first gripper and second gripper are positioned laterally on opposite sides of the second end of the second end of the elongated member;

a spring being positioned between the first end of the elongated member and the grip;

wherein the hook is detachably attachable to the grip; and the actuation mechanism comprising a first gear and a second gear.

12. The pool skimmer safety tool of claim 11, further comprising:

the first gripper comprising a plurality of interlocking teeth and a plurality of slots; and the second gripper comprising a plurality of interlocking teeth and a plurality of slots.

13. The pool skimmer safety tool of claim 12, further comprising:

wherein the plurality of teeth of the first gripper are positioned to slot into the plurality of slots on the second gripper; and wherein the plurality of teeth on the second gripper are positioned to slot into the plurality of slots on the first gripper.

14. The pool skimmer safety tool of claim 11, further comprising:

wherein the first gear is operatively connected to the second gear.

15. The pool skimmer safety tool of claim 14, further comprising:

wherein the first gear is further operatively connected to the first gripper and the second gear is operatively connected to the second gripper.

16. The pool skimmer safety tool of claim 11, further comprising:

the hook further comprising a straight portion and a hooked portion.

17. A pool skimmer safety tool comprising:

a pincer mechanism;

an elongated member;

a hook;

an actuation mechanism;

a grip;

a trigger;

the elongated member comprising a first end and a second end;

the grip is positioned at the first end of the elongated member;

the pincer mechanism is positioned at the second end of the elongated member;

the trigger is positioned on the grip;

the trigger being operatively connected to the actuation mechanism;

the actuation mechanism being operatively connected to the pincer mechanism;

the pincer mechanism further comprising a first gripper and a second gripper;

the first gripper and second gripper are positioned laterally on opposite sides of the second end of the second end of the elongated member;

the first gripper comprising a plurality of interlocking teeth and a plurality of slots;

the second gripper comprising a plurality of interlocking teeth and a plurality of slots;

wherein the plurality of teeth of the first gripper are positioned to slot into the plurality of slots on the second gripper;

wherein the plurality of teeth on the second gripper are positioned to slot into the plurality of slots on the first gripper;

the hook further comprising a straight portion and a hooked portion;

wherein the hook is detachably attachable to the grip;

the actuation mechanism comprising a first gear and a second gear;

a spring being positioned between the first end of the elongated member and the grip;

wherein the first gear is operatively connected to the second gear; and wherein the first gear is further operatively connected to the first gripper and the second gear is operatively connected to the second gripper.

* * * * *